US007832435B1

(12) United States Patent
Liu

(10) Patent No.: US 7,832,435 B1
(45) Date of Patent: Nov. 16, 2010

(54) CUTTER HEAD OF A PLANAR MACHINE

(76) Inventor: Chin-Yuan Liu, No. 107, Shih Chuan Street, Tung District, Taichung City (TW)

( * ) Notice: Subject to any disclaimer, the term of this patent is extended or adjusted under 35 U.S.C. 154(b) by 45 days.

(21) Appl. No.: 12/436,513

(22) Filed: May 6, 2009

(51) Int. Cl.
*B27C 1/00* (2006.01)
*B26D 7/26* (2006.01)

(52) U.S. Cl. ..... 144/117.1; 144/218; 144/225; 83/698.41; 407/48

(58) Field of Classification Search ..... 144/162.1, 144/172, 174, 218, 220, 230, 224–227, 114.1, 144/117.1, 221; 83/698.41, 698.42, 698.51, 83/699.51; 407/40, 47, 48, 107
See application file for complete search history.

(56) References Cited

U.S. PATENT DOCUMENTS 1,294,638 A * 2/1919 Draper ..... 144/225
3,673,907 A * 7/1972 Watanabe ..... 83/674
4,066,111 A * 1/1978 Klebe, Jr. ..... 30/475
5,398,739 A * 3/1995 Everts et al. ..... 144/225
7,051,776 B2 * 5/2006 Liu ..... 144/117.1
7,100,649 B2 9/2006 Liu

* cited by examiner

*Primary Examiner*—Shelley Self
(74) *Attorney, Agent, or Firm*—Frommer Lawrence & Haug LLP; Ronald R. Santucci

(57) ABSTRACT

A cutter head of a planer machine includes a rotatable mount body having opposite flat mount and counter regions that are symmetrical to each other, a cutter blade disposed to abut against the flat mount region so as to enable a cutting edge to extend beyond a lateral end of the mount region, a press member having a tightened body which is tightened against the mount region, and a pressing strip which is brought to press the cutter blade against the mount region, and a counterweight disposed on the counter region so as to balance the combined weights of the cutter blade and the press member for smoothing the rotation of the mount body.

10 Claims, 7 Drawing Sheets

CUTTER HEAD OF A PLANAR MACHINE

BACKGROUND OF THE INVENTION

1. Field of the Invention

This invention relates to a cutter head of a planer machine, more particularly to a cutter head having an elongated cutter blade mounted on a flat mount region of a rotatable elongated mount body.

2. Description of the Related Art

In U.S. Pat. No. 7,100,649 B2 as shown in FIGS. 1 and 2, the applicant disclosed a rotary cutter 10 for a wood planing machine (not shown) that includes an elongated polygonal-shaped shaft 11 which defines a rotating axis and which has two opposite mounting ends 111, and three axially extending flat blade-mounting surfaces 112 parallel to and equidistant from the rotating axis and extending between the mounting ends 111; a pair of blade-aligning members 14, each of which is mounted on a respective one of the mounting ends 111, and each of which is formed with three protrusions 141; three blades 12, each of which is attached to a respective one of the blade-mounting surfaces 112, and each of which has two opposite end portions 121 with recesses 122 that respectively receive the protrusions 141 of the blade-aligning members 14; and three blade-fastening plates 15 and screw fasteners 16 for fastening the blades 12 to the shaft 11.

In the aforementioned patent, the angle defined between every two adjacent ones of the blade-mounting surfaces 112 is configured to be the same in order to balance the combined weight of the blades 12 and the blade-fastening plates 15 for smoothing the rotation of the shaft 11. In addition, the load borne by a power motor (not shown) of the wood planing machine when during rotation of the three blades 12 during a cutting operation is relatively heavy, and material costs of the blades 12 are relatively high. Moreover, during replacement of the blades 12, the blades 12 have to be aligned with the shaft 11 so that the amounts of exposure of the blades 12 are the same, thereby rendering the assembling of the rotary cutter 10 troublesome.

SUMMARY OF THE INVENTION

An object of the present invention is to provide a cutter head of a planer machine which has a single elongated cutter blade that can be easily and precisely mounted on a flat mount region of an elongated mount body to minimize material costs.

According to this invention, the cutter head of a planer machine includes an elongated mount body which extends along a rotating axis to terminate at front and rear ends, and which has a surrounding outer wall surface. The outer wall surface includes flat mount and counter regions which extend between the front and rear ends and which are symmetrical to each other with respect to the rotating axis, and left and right rounded regions which interconnect the flat mount and counter regions and which are symmetrical to each other with respect to the rotating axis. Front and rear journalled couplers extend respectively from the front and rear ends along the rotating axis, and are revolved so as to rotate the elongated mount body about the rotating axis. An elongated cutter blade has an elongated blade body which is secured to and which abuts against the flat mount region such that an elongated cutting edge of the cutter blade extends beyond a lateral end of the mount region. An elongated press member has an elongated tightened body tightened against the flat mount region, and an elongated pressing strip brought to press the elongated blade body against the flat mount region, thereby ensuring firm abutment of the elongated blade body against the flat mount region. A counterweight is disposed on the flat counter region, and is configured to balance the combined weights of the elongated cutter blade and the elongated press member so as to smooth rotation of the elongated mount body. Preferably, the counterweight is integrally formed with the mount body.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
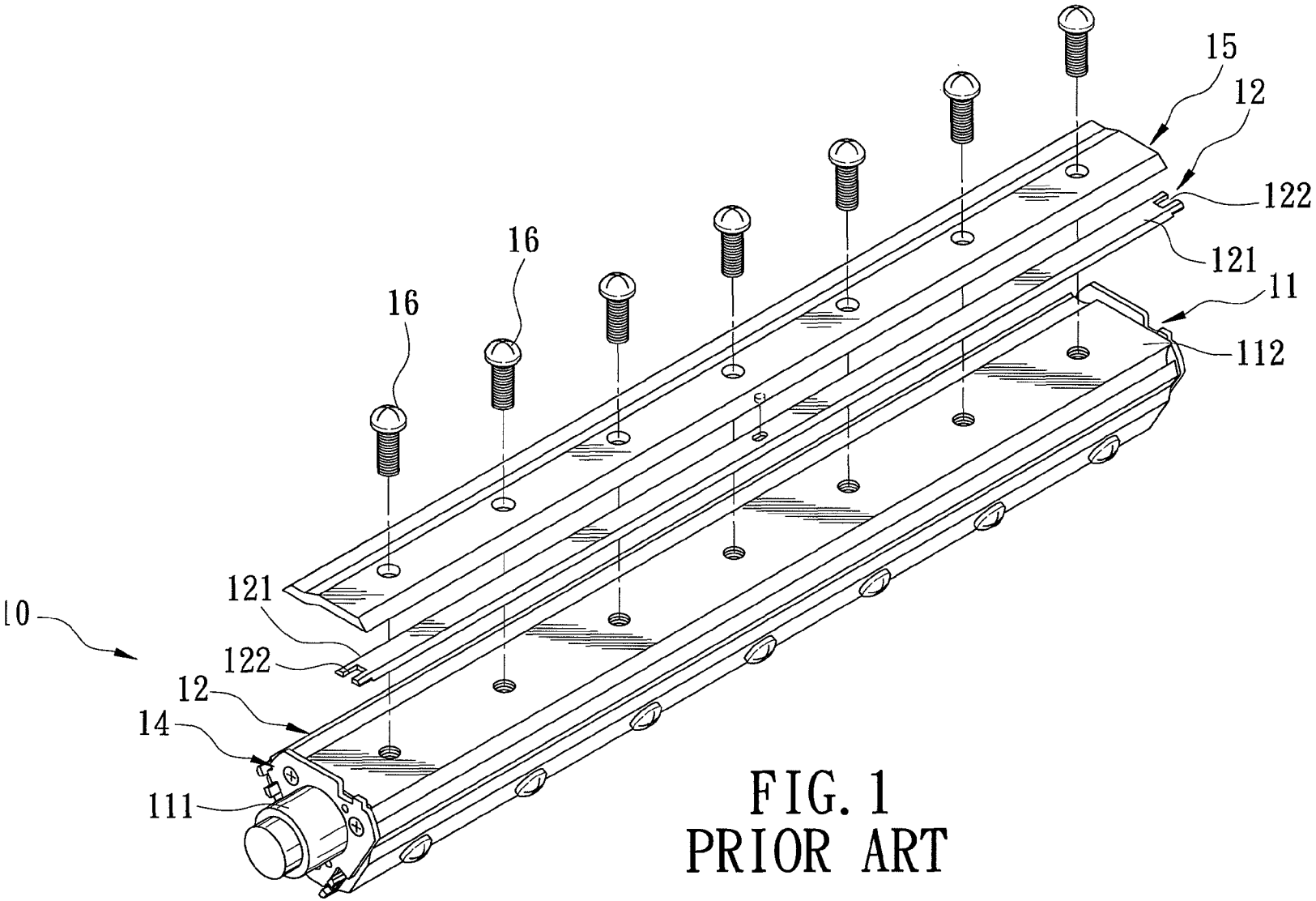
FIG. 1 PRIOR ART
FIG. 1 is an exploded perspective view of a conventional rotary cutter for a wood planing machine.
Figure 2:
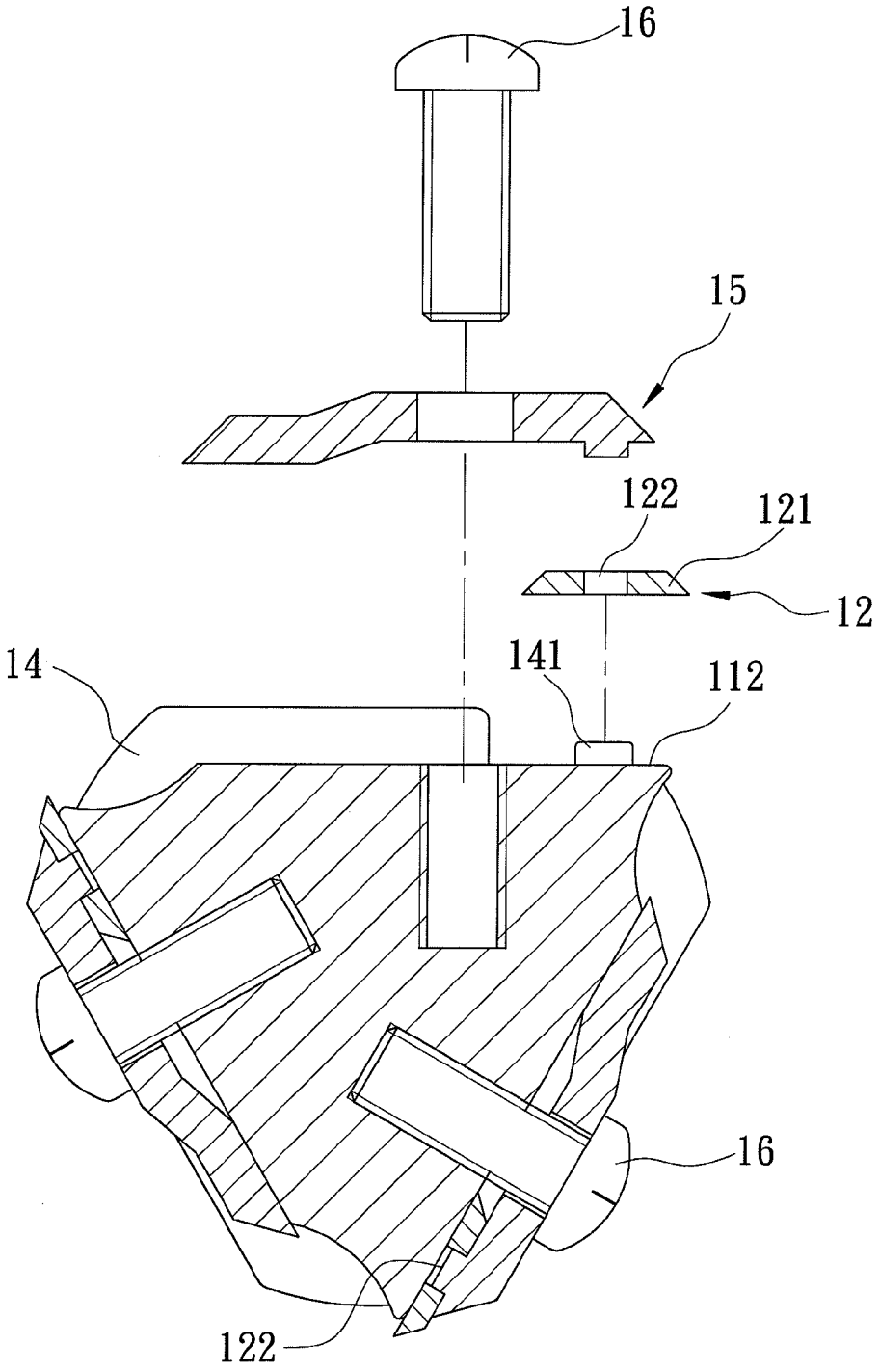
FIG. 2 PRIOR ART
FIG. 2 is a partly exploded, sectional view of the conventional rotary cutter.

Before the present invention is described in greater detail, it should be noted that same reference numerals have been used to denote like elements throughout the specification.

Figure 3:
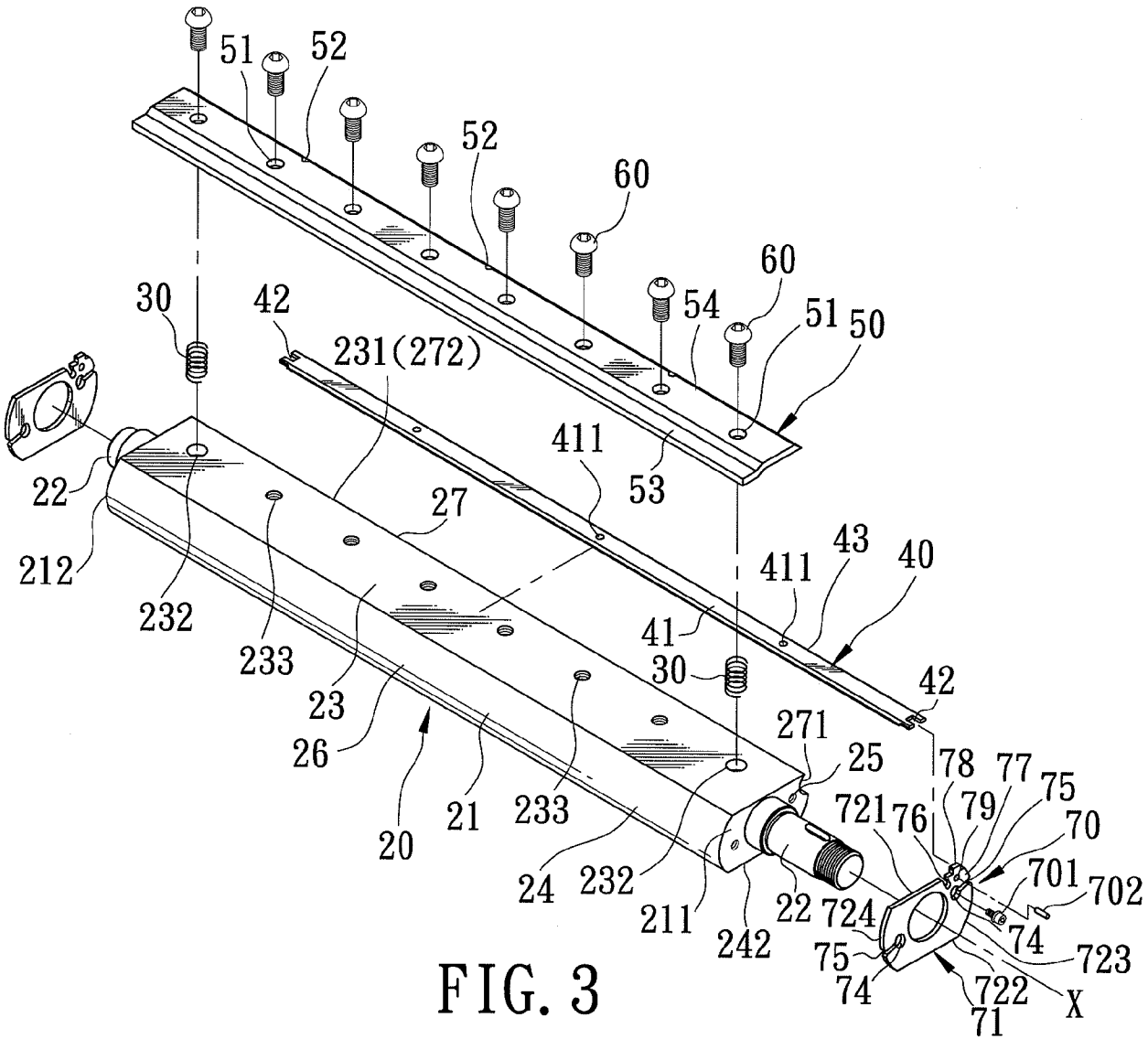
FIG. 3 is an exploded perspective view of the preferred embodiment of a cutter head of a planer machine according to this invention.
Figure 4:
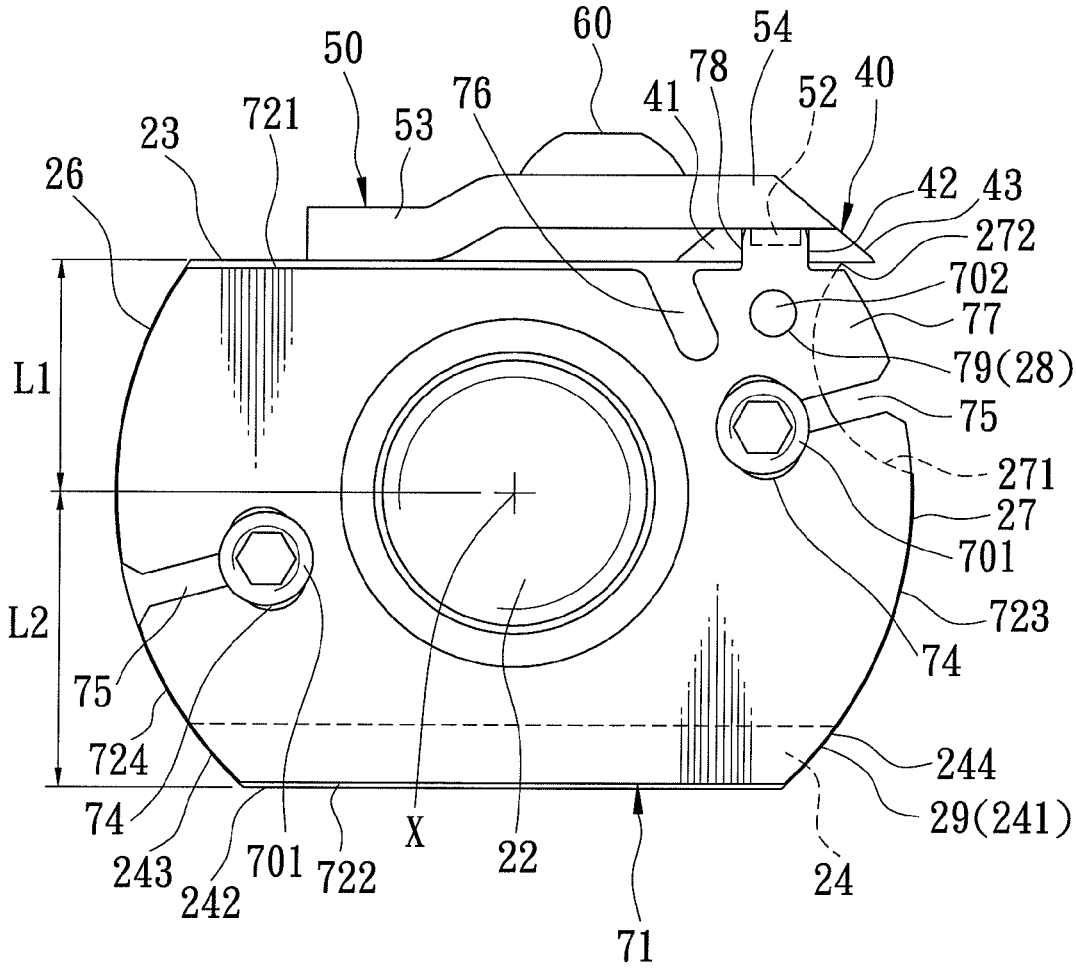
FIG. 4 is a front view of the preferred embodiment.

Referring to FIGS. 3 and 4, the preferred embodiment of a cutter head of a planer machine according to the present invention is shown to comprise a rotary shaft 20, an elongated cutter blade 40, an elongated press member 50, a counterweight 24, and a pair of blade aligning units 7.

The rotary shaft 20 includes an elongated mount body 21 and front and rear journalled couplers 22. The elongated mount body 21 extends along a rotating axis (X) in a longitudinal direction to terminate at front and rear ends 211,212, and has a surrounding outer wall surface that surrounds the rotating axis (X). The surrounding outer wall surface includes a flat mount region 23 which extends between the front and rear ends 211,212, which extends in a first transverse direction to terminate at a lateral end 231 that extends in a direction parallel to the rotating axis (X), and which is distant from the rotating axis (X) by a first length (L1); a flat counter region 29 which extends between the front and rear ends 211,212, and which is symmetrical to the mount region 23 with respect to the rotating axis (X); and left and right rounded regions 26,27 which interconnect the flat mount and counter regions 23,29, which are disposed opposite to each other in the first transverse direction, and which are configured to be symmetrical to each other with respect to the rotating axis (X). The right rounded region 27 has a concavity 271 which extends in the longitudinal direction, and which, together with the lateral end 231, forms a cliff edge 272. In addition, the mount body 21 has front and rear screw holes 232 and a plurality of middle screw holes 233 formed in the flat mount region 23.

The front and rear journalled couplers 22 extend respectively from the front and rear ends 211,212 along the rotating axis (X), and are revolved so as to rotate the elongated mount body 21 about the rotating axis (X).

The elongated cutter blade 40 has an elongated cutting edge 43 which extends in the longitudinal direction, and an elongated blade body 41 which extends in the longitudinal direction, and which is opposite to the elongated cutting edge 43 in the first transverse direction such that, when the elongated blade body 41 is secured to and abuts against the flat mount region 23, the elongated cutting edge 43 extends beyond the cliff edge 272 for performing a cutting operation when the elongated mount body 21 is rotated about the rotating axis (X). In addition, the blade body 41 of the cutter blade 40 has two recesses 42 extending inwardly and respectively from two opposite ends of the blade body 41 in the longitudinal direction.

The elongated press member 50 has an elongated tightened body 53 extending in the longitudinal direction, and an elongated pressing strip 54 opposite to the elongated tightened body 53 in the first transverse direction. The tightened body 53 has a plurality of through holes 51 which are disposed to be respectively aligned with the front, rear and middle screw holes 232,233 in the flat mount region 23.

A plurality of screw fasteners 60 are disposed to extend respectively through the through holes 51 and to threadedly engage the front, rear and middle screw holes 232,233, respectively, so as to tighten the elongated tightened body 53 against the flat mount region 23. Thus, the elongated pressing strip 54 is brought to press the elongated blade body 41 against the flat mount region 23, thereby ensuring firm abutment of the elongated blade body 41 against the flat mount region 23 when the elongated cutting edge 43 is performing a cutting operation. Preferably, front and rear coiled springs 30 are respectively disposed in the front and rear screw holes 232 to bias the press member 50 away from the flat mount region 23 so as to facilitate removal of the cutter blade 40 and the press member 50 from the mount body 21 during replacement of the cutter blade 40.

The counterweight 24 is disposed on the flat counter region 29, and is configured to balance the combined weights of the cutter blade 40 and the press member 50 so as to smooth rotation of the elongated mount body 21. Specifically, the counterweight 24 has a boundary surface 241 which is connected to the entire area of the flat counter region 29, a flat counterweight surface 242 which is opposite to the boundary surface 241 in a second direction transverse to the longitudinal direction and the first transverse direction, and which extends in the longitudinal direction between the front and rear ends 211,212, and left and right outer surfaces 243,244 which are opposite to each other in the first transverse direction, and which interconnect the boundary surface 241 and the counterweight surface 242. Each of the left and right outer surfaces 243,244 is configured to form a rounded profile with a respective one of the left and right rounded regions 26,27. Preferably, the boundary surface 241 is integrally formed with the flat counter region 29 such that the flat counterweight surface 242 is distant from the rotating axis (X) by a second length (L2) that is greater than the first length (L1).

Each of the blade aligning units 7 includes a plate 71 which is sleeved on a respective one of the front and rear journalled couplers 22 and which is secured to a respective one of the front and rear ends 211,212 of the mount body 21. The plate 71 has first and second peripheral sides 721,722 and left and right peripheral sides 724,723 which are respectively flush with the flat mount region 23, the flat counterweight surface 242, and the left and right rounded regions 26,27. The plate 71 further has left and right locking holes 74 which extend therethrough in the longitudinal direction and which are disposed respectively proximate to the left and right peripheral sides 724,723, two first adjusting slots 75 which are respectively formed in the left and right peripheral sides 724,723 and which respectively extend to be communicated with the left and right locking holes 74, and a second adjusting slot 76 which is formed in the first peripheral side 721 and which extends toward the right locking hole 74 so as to cooperatively define an adjusting region 77 with the right locking hole 74 and the first and right peripheral sides 721,723. A pin hole 79 extends through the adjusting region 77 in the longitudinal direction. A protrusion 78 extends from the first peripheral side 721 in the second transverse direction, and is configured to be matingly inserted into a respective one of the recesses 42 in the cutter blade 40.

In assembly, the coiled springs 30 are respectively disposed in the front and rear screw holes 232, and the cutter blade 40 and the press member 50 are mounted on the flat mount region 23 such that each of the recesses 42 is located at a position beyond the respective one of the front and rear ends 211,212 of the mount body 21. The plate 71 of each blade aligning unit 7 is sleeved on the corresponding journalled coupler 22, and the protrusion 78 is inserted into the corresponding recess 42. Subsequently, two screw fasteners 701 are respectively extended through the left and right locking holes 74 to threadedly engage the respective one of the front and rear ends 211,212 so as to partially secure the plate 71 to the mount body 21.

Figure 5:
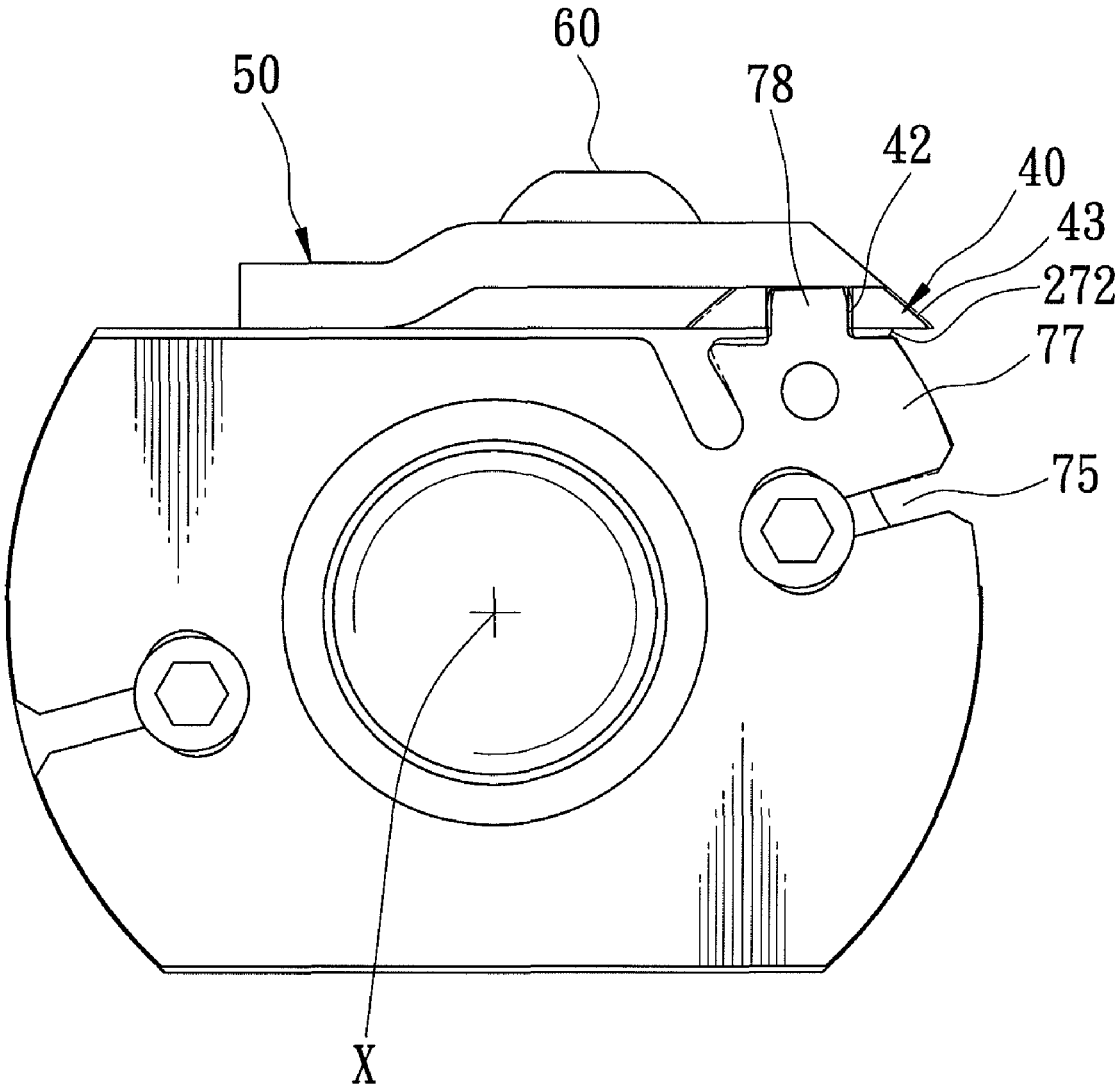
FIG. 5 is a view similar to FIG. 4, illustrating how a cutter blade is adjusted in a first adjusted state.
Figure 6:
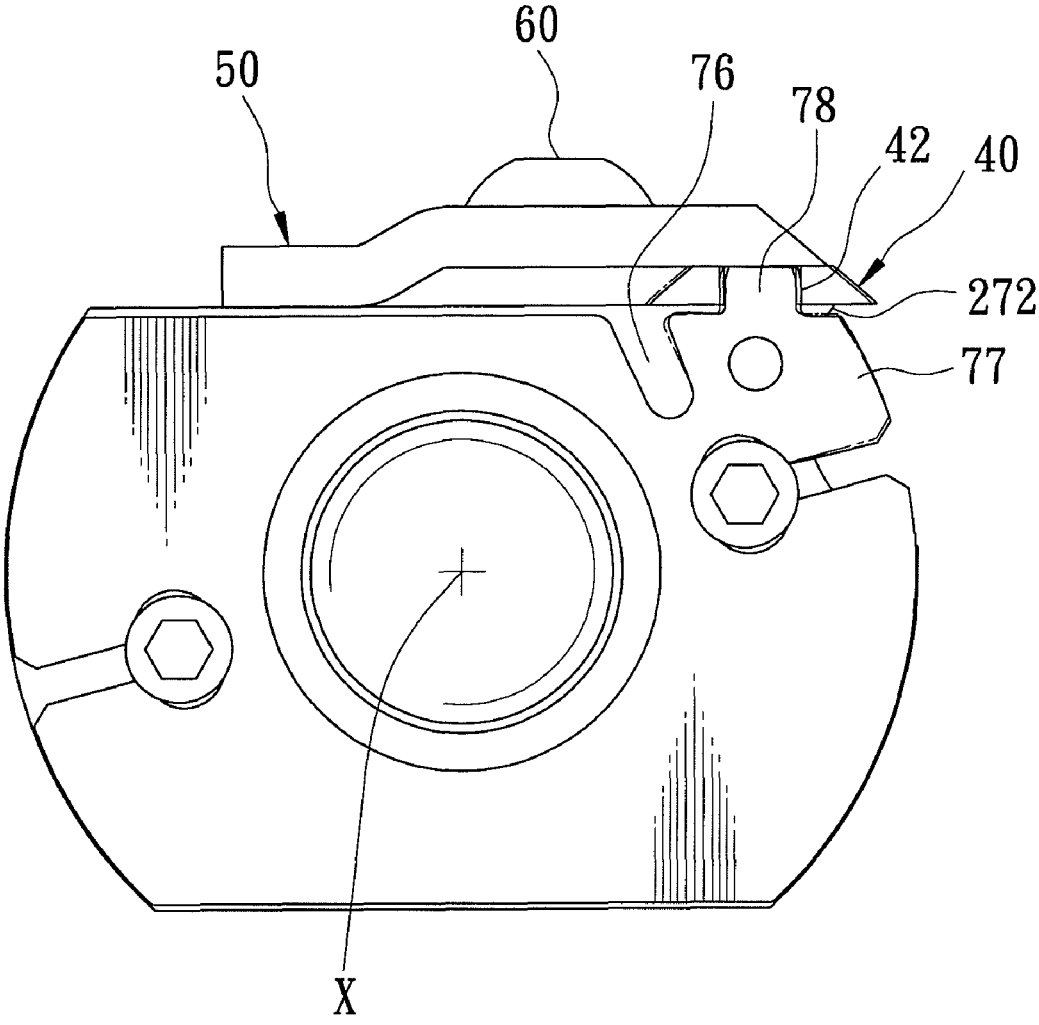
FIG. 6 is a view similar to FIG. 4, illustrating how the cutter blade is adjusted in a second adjusted state.

Thereafter, a blade adjusting operation can be performed. Referring to FIG. 5, a tool (not shown), such as a screw driver, can be inserted into one of the first adjusting slots 75 to move the adjusting region 77 toward the rotating axis (X) so that the cutter blade 40 is moved with the protrusion 78 toward the rotating axis (X) (i.e., the adjusting region 77 and the cutter blade 40 are moved from a position indicated by dotted lines to a position indicated by solid lines as illustrated in FIG. 5), thereby reducing the amount of exposure of the cutting edge 43. On the other hand, when a tool (not shown) is inserted into the second adjusting slot 76 to move the adjusting region 77 away from the rotating axis (X), the cutter blade 40 is moved with the protrusion 78 away from the rotating axis (X) (i.e., the adjusting region 77 and the cutter blade 40 are moved from a position indicated by dotted lines to a position indicated by solid lines as illustrated in FIG. 6), thereby increasing the amount of exposure of the cutting edge 43. Thus, the cutting edge 43 can be adjusted in the above-described manner to be precisely aligned with the cliff edge 272.

Referring again to FIGS. 3 and 4, the screw fasteners 701 are subsequently tightened so as to secure the plate 71 firmly to the mount body 21. A drill tool (not shown) is then extended through the pin hole 79 to form a drill hole 28 in the corresponding one of the front and rear ends 211,212, and a pin 702 is extended through the pin hole 79 and into the drill hole 28. Thus, the plate 71 can be secured firmly to the corresponding one of the front and rear ends 211,212, and the structure of the plate 71 at the adjusting region 77 can be strengthened.

Preferably, as shown in FIG. 3, the blade body 41 and the pressing strip 54 respectively have a plurality of first positioning holes 411 and a plurality of first studs 52 which are mated with each other to facilitate alignment of the cutting edge 43 with the cliff edge 272 in the longitudinal direction.

Figure 7:
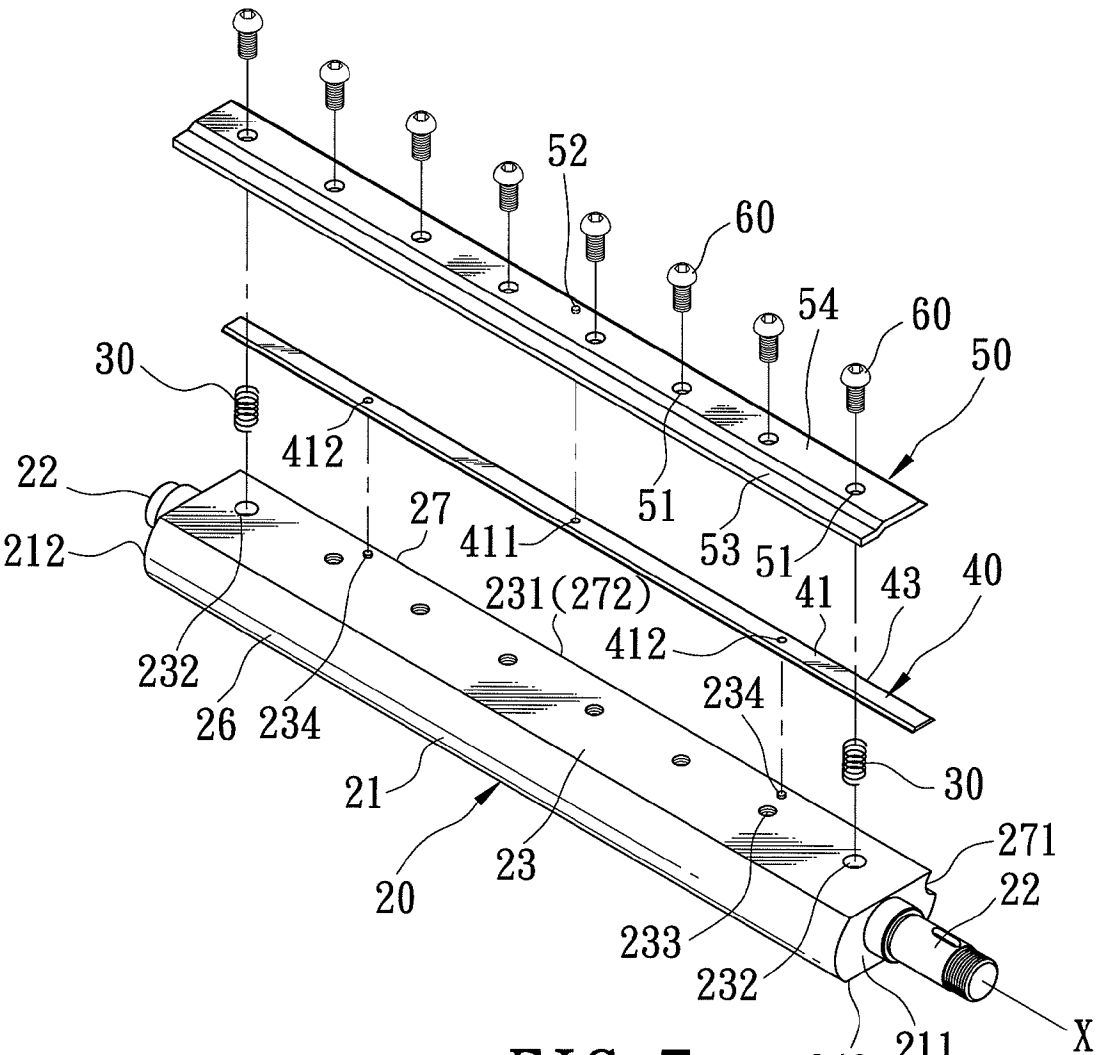
FIG. 7 is an exploded perspective view of another preferred embodiment of a cutter head of a planer machine according to this invention.

FIG. 7 shows another preferred embodiment of a cutter head of a planer machine according to this invention, which is similar to the aforesaid embodiment in construction. In this embodiment, the blade aligning units 7 which include the plates 71, the screw fasteners 701, and the pins 702 are dispensed with. Instead, the blade body 41 of the cutter blade 40 and the flat mount region 23 of the elongated mount body 21 respectively have a plurality of second positioning holes 412 and a plurality of second studs 234 which are mated with each other for aligning the cutting edge 43 with the cliff edge 272 in the longitudinal direction. In assembly, the coiled springs 30 are respectively disposed in the front and rear screw holes 232, and the cutter blade 40 is positioned on the flat mount region 23 by virtue of the engagement between the second positioning holes 412 and the second studs 234. Subsequently, the press member 50 is placed on the cutter blade 40 and the coiled springs 30, and is positioned on the flat mount region 23 by virtue of the engagement between the first positioning hole 411 and the first stud 52 such that the through holes 51 are aligned with the front, rear and middle screw holes 232,233, respectively. Then, the press member 50 is tightened to the mount body 21 by means of the screw fasteners 60.

As illustrated, since one single cutter blade 40 is provided on the shaft 20, precise alignment of the cutting edge 43 is easy to conduct, and the material cost of the cutter head is reduced. In addition, due to the provision of the counterweight 24, smooth rotation of the shaft 20 is ensured when performing a cutting operation.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A cutter head of a planer machine, comprising:

an elongated mount body which extends along a rotating axis in a longitudinal direction, which terminates at front and rear ends, and which has a surrounding outer wall surface that surrounds the rotating axis, said surrounding outer wall surface including a flat mount region which extends between said front and rear ends, which extends in a first transverse direction to terminate at a lateral end that extends in a direction parallel to the rotating axis, and which is distant from the rotating axis by a first length, a flat counter region which extends between said front and rear ends, and which is symmetrical to said mount region with respect to the rotating axis, and left and right rounded regions which interconnect said flat mount and counter regions, which are disposed opposite to each other in the first transverse direction, and which are configured to be symmetrical to each other with respect to the rotating axis;

front and rear journalled couplers which extend respectively from said front and rear ends along the rotating axis, and which are revolved so as to rotate said elongated mount body about the rotating axis;

an elongated cutter blade having an elongated cutting edge which extends in the longitudinal direction, and an elongated blade body which extends in the longitudinal direction, and which is opposite to said elongated cutting edge in the first transverse direction such that, when said elongated blade body is secured to and abuts against said flat mount region, said elongated cutting edge extends beyond said lateral end for performing a cutting operation when said elongated mount body is rotated about the rotating axis;

an elongated press member which has an elongated tightened body extending in the longitudinal direction, and an elongated pressing strip opposite to said elongated tightened body in the first transverse direction such that, when said elongated tightened body is tightened against said flat mount region, said elongated pressing strip is brought to press said elongated blade body against said flat mount region, thereby ensuring firm abutment of said elongated blade body against said flat mount region when said elongated cutting edge is performing a cutting operation; and a counterweight which is disposed on said flat counter region, and which is configured to balance the combined weights of said elongated cutter blade and said elongated press member so as to smooth rotation of said elongated mount body.

2. The cutter head according to claim 1, wherein said counterweight has a boundary surface which is connected to an entire area of said flat counter region, and a flat counterweight surface which is opposite to said boundary surface in a second direction transverse to the longitudinal direction and the first transverse direction, and which extends in the longitudinal direction between said front and rear ends, said counterweight further having left and right outer surfaces which are opposite to each other in the first transverse direction, and which interconnect said boundary surface and said counterweight surface, each of said left and right outer surfaces being configured to form a rounded profile with a respective one of said left and right rounded regions.

3. The cutter head according to claim 2, wherein said boundary surface is integrally formed with said flat counter region, said flat counterweight surface being distant from the rotating axis by a second length that is greater than the first length.

4. The cutter head according to claim 2, wherein said right rounded region has a concavity which extends in the longitudinal direction, and which, together with said lateral end, forms a cliff edge such that said cutting edge extends beyond said cliff edge for performing a cutting operation.

5. The cutter head according to claim 2, wherein said blade body has two recesses which extend inwardly and respectively from two opposite ends thereof, said cutter head further comprising a pair of blade aligning units, each including a plate sleeved on a respective one of said front and rear journalled couplers and secured to a respective one of said front and rear ends of said elongated mount body, said plate having first and second peripheral sides and left and right peripheral sides which are respectively flush with said flat mount region, said flat counterweight surface, said left and right rounded regions, said plate further having left and right locking holes which extend therethrough in the longitudinal direction and which are disposed respectively proximate to said left and right peripheral sides, two first adjusting slots which are respectively formed in said left and right peripheral sides and which extend to be communicated with said left and right locking holes, and a second adjusting slot which is formed in said first peripheral side and which extends toward said right locking hole so as to cooperatively define an adjusting region with said right locking hole and said first and right peripheral sides, a protrusion which extends from said first peripheral side in the second transverse direction, and which is configured to be matingly inserted into a respective one of said recesses, and two screw fasteners which are disposed to extend respectively through said left and right locking holes and to threadedly engage the respective one of said front and rear ends.

6. The cutter head according to claim 5, wherein each of said blade aligning units further includes a pin hole which extends through said adjusting region in the longitudinal direction, and a pin which is disposed to extend through said pin hole and to be secured to the respective one of said front and rear ends.

7. The cutter head according to claim 1, wherein said mount body has front and rear screw holes and a plurality of middle screw holes formed in said flat mount region, said tightened body having a plurality of through holes which are disposed to be aligned with said front, rear, and middle screw holes, respectively, said cutter head further comprising a plurality of screw fasteners which are disposed to extend respectively through said through holes to threadedly engage said front, rear, and middle screw holes, respectively, so as to secure said blade body to said flat mount region.

8. The cutter head according to claim 7, further comprising front and rear coiled springs which are respectively disposed in said front and rear screw holes to bias said press member away from said mount region.

9. The cutter head according to claim 4, wherein said blade body and said pressing strip respectively have at least one first positioning hole and at least one first stud which are mated with each other for aligning said cutting edge with said cliff edge in the longitudinal direction.

10. The cutter head according to claim 4, wherein said blade body and said mount region respectively have at least one second positioning hole and at least one second stud which are mated with each other for aligning said cutting edge with said cliff edge in the longitudinal direction.

* * * * *